United States Patent [19]

Adams

[11] 3,942,273

[45] Mar. 9, 1976

[54] MILITARY RIBBON HOLDER

[76] Inventor: Thomas D. Adams, 1704 Keyline Drive, Lemon Grove, Calif. 92045

[22] Filed: Apr. 8, 1974

[21] Appl. No.: 459,121

Related U.S. Application Data

[63] Continuation-in-part of Ser. No. 362,910, May 23, 1973, abandoned.

[52] U.S. Cl. ..... 40/1.5; 85/46

[51] Int. Cl.[2] ..... A44C 3/00

[58] Field of Search ..... 85/46, DIG. 2, 32; 40/1.5, 40/1.6, 20, 143; 24/105

[56] References Cited

UNITED STATES PATENTS

| | | | |
|---|---|---|---|
| 80,299 | 7/1868 | Martin | 85/46 |
| 1,569,443 | 1/1926 | Weed | 40/1.5 |
| 2,144,926 | 1/1939 | Lawton | 40/1.5 |
| 2,339,364 | 1/1944 | Thomas | 40/1.5 |
| 2,707,344 | 5/1955 | Bolognese | 40/1.5 |
| 2,832,161 | 4/1958 | Murphy | 40/1.5 |
| 2,878,905 | 3/1959 | Langermeier | 85/DIG. 2 |
| 3,579,881 | 5/1971 | Cherry | 40/1.5 |

FOREIGN PATENTS OR APPLICATIONS

| | | | |
|---|---|---|---|
| 757,828 | 5/1967 | Canada | 85/46 |
| 886,061 | 1/1962 | United Kingdom | 85/46 |

*Primary Examiner*—Louis G. Mancene
*Assistant Examiner*—Wenceslao J. Contreras
*Attorney, Agent, or Firm*—Brown & Martin

[57] ABSTRACT

A holder for military uniforms that is secured through the fabric of the uniform by a threaded pin member. The pin is engaged by a threaded nut bearing against the reverse side of the uniform. The threads on the pin member are less than one-half the depth of the threads on the nut. The nut is comprised of acetal resin so that the relatively larger nut threads flexibly engage the pin member threads and provide a secure threaded relationship without stripping of the nut or pin threads due to cross-threading or other mistreatment.

10 Claims, 4 Drawing Figures

MILITARY RIBBON HOLDER

RELATION TO OTHER APPLICATIONS

This application is a continuation-in-part of applicant's co-pending application entitled "Holder for Military Ribbons", Ser. No: 362,910 Filed: May 23, 1973, now abandoned

BACKGROUND OF THE INVENTION

Prior art devices for securing military ribbons to military uniforms have been deficient in several respects. For example, in a common military ribbon holder, a smooth shank spring is utilized to secure the holder to the uniform by penetrating the uniform and engaging a friction type spring biased clamp. In embodiments of this prior art device where provision is made for plural rows of ribbons, the prongs have been secured through the channels holding the ribbons. The spring biased clamp is sufficient to hold the channels and holder on the uniform during the initial application; however, during subsequent movements of the user, with the attendent forces transmitted to the holder, the fasteners tend to work loose, resulting in one or more of the prongs pulling free of the uniform and in partial or complete disconnection and loss of the holder. Not only is the loss of the holder a financial disadvantage, but results in considerable embarrassment and potential discomfort to the user. Further, in such prior art devices, the failure to provide for adequate structural connection between the various parallel channels frequently results in a fracture and separation or loosening of the channels with respect to one another, and again results in potential unsightly appearance of the uniform and loss of the holder.

Other prior art ribbon holders have been proposed which utilize a screw fastener. Such devices work in an acceptable fashion on uniforms that have holes provided to receive the shank of the screw. However, in those applications where it is necessary to penetrate the fabric of the uniform the threads on the screw fastener devices grab and tear at the uniform fabric rather than penetrating the fabric smoothly. As a result, with continued use, the fabric of the uniform is substantially deteriorated, necessitating its premature replacement. Additionally, the tendency of the threads snagging on the fabric in the uniform complicates the process of attachment of the ribbon holder and increases the time necessary therefor.

Because of the problems of snagging and pulling particularly on the synthetic fabric of certain uniforms and on multi-layered uniforms, it has been generally assumed that it is not possible to make an acceptable threaded-type, military ribbon holder.

It is therefore desirable to have a holder for military ribbons that is held securely to the uniform with a screw-type fastener, that does not easily disengage in service, and which does not become entrapped or engaged by the fabric of the uniform and thereby is easily installed onto the uniform without damage thereto. Such a holder is particularly desirable where the various ribbon supporting channels are securely positioned with respect to one another by structure that resists breakage in use.

SUMMARY OF THE INVENTION

An exemplary embodiment of the invention incorporates a plurality of ribbon support channels positioned in a substantially horizontal and vertically spaced apart parallel relationship. The ribbon support channels are configured in cross-section to be substantially a truncated triangle, and in the exemplary embodiment have an open base configuration to provide maximum strength and spring grasping capability with minimum weight and manufacturing costs. Where a plurality of channels are to be provided, they are spaced and secured one to the other by vertical channel support bars. A plurality of bars are utilized to insure against relative movement and fracture of the connection between the various ribbon support channels.

A plurality of threaded pins are utilized, with the exact number depending on the overall size of the holder. Each pin has an unthreaded shank portion which is connected to the ribbon support channels. The unsecured end of the threaded member terminates in a pointed end to facilitate the penetration of the uniform fabric. The threaded portion of the shank incorporates a non-standard modified thread configuration. In the exemplary embodiment the threads are 00/90 type threads with the major and minor diameters modified to produce a minor diameter of 0.035 inches and a major diameter of 0.041 inches. Thus the total thread depth is 0.003 inches.

The threaded pin is made up of machinable stainless steel which has the requisite wearability and strength in shear for the fastener aspect of the operation, and in addition is durable and retains its finish over a long period of time.

The same thread type, but unmodified, is incorporated in the threads of the threaded uut. The nut is comprised of a flexible plastic material and is threaded to the standard depth of 0.0085 inches. This is accomplished by machining threads which produce a minor diameter of 0.035 inches and a major diameter of 0.052 inches. While the particular combination of thread depth pitch and major/minor diameter has been found to be optimum in that it provides uninhibited piercing of the material fabric while maximizing the available threads for securely fastening the nut to the pin. However, experimentation indicates, that so long as the threads on the shank are one-half the depth of that of the associated nut that substantial improvement in the insertion and holding characteristics can be obtained so long as the maximum thread depth on the threaded shank is maintained in the range of 0.002 to 0.005 inches.

Thus, there is produced a military ribbon holder than can be inserted through substantially all types of fabrics including synthetics, presently in use in military uniforms, and including those uniforms made up of several layers of different materials. The holder may be securely fastened to the uniform by the threaded nut such that the device does not work loose in use. The materials employed make it possible for the device to withstand many thousands of operations without significant wear.

It is therefore an object of the invention to provide a new and improved holder for military ribbons.

It is another object of the invention to provide a new and improved holder for military ribbons which is simple in design and construction.

It is another object of the invention to provide a new and improved holder for military ribbons which is relatively low in cost.

It is another object of the invention to provide a new and improved holder for military ribbons that will not work loose during use.

It is another object of the invention to provide a new and improved holder for military ribbons that provides improved structure for connecting the plural ribbon support channels.

It is another object of the invention to provide a new and improved holder for military ribbons which is relatively light in weight.

It is another object of the invention to provide a new and improved holder for military ribbons that does not snag or hang up on the fabric of military uniforms.

It is another object of the invention to provide a new and improved holder for military ribbons that has a long service life.

Other objects and many attendant advantages of the invention will become more apparent upon a reading of the following detailed description, together with the drawings in which like reference numerals refer to like parts throughout and in which.

Figure 1:
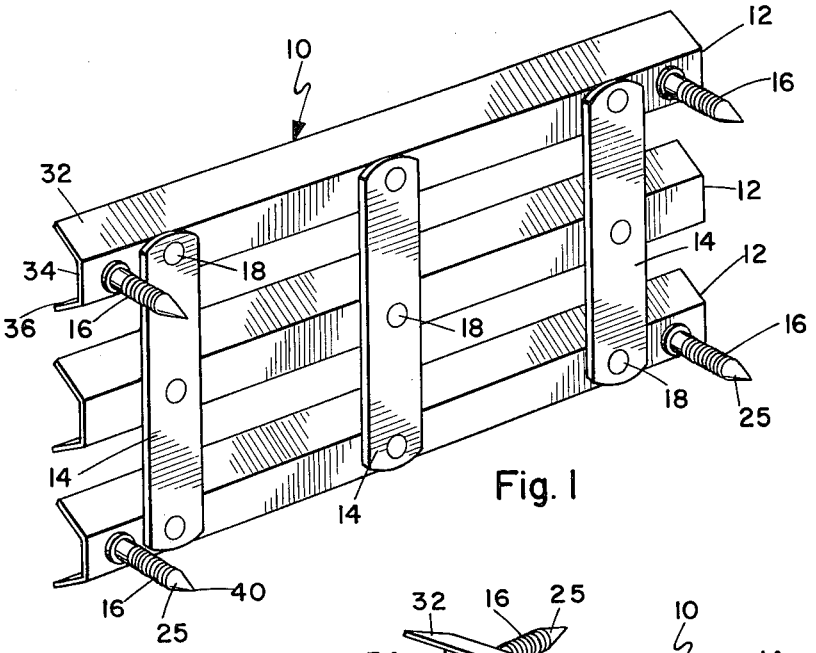
FIG. 1 is a perspective view from the rear of a typical multiple row holder.
Figure 2:
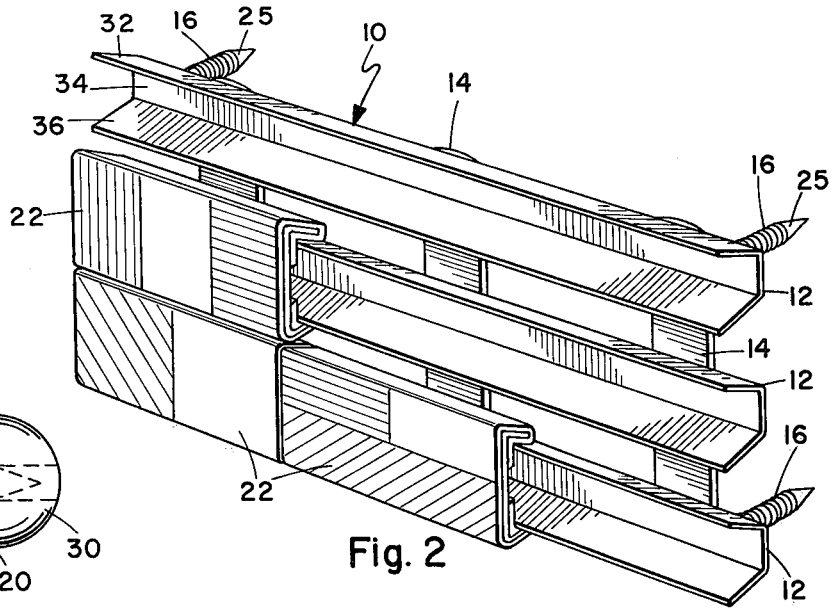
FIG. 2 is a perspective view of the holder from the front, with several ribbons in place.

Referring now to the drawings there is illustrated a military ribbon holder 10. The ribbon holder 10 is comprised of a plurality of horizontal and parallel ribbon support channels 12. The channels are spaced and secured together by vertical channel support bars 14 and a plurality of spot welds 18. Threaded pins 16 are secured to the channels 12 and adjacent to the end support bars 14 and protrude substantially perpendicularly from the channels. Referring to the FIG. 3 the holder 10 is illustrated in position on a military uniform. The pins 16 have penetrated the fabric 26 of the uniform and a plurality of threaded nuts 20 are received over the threads of the pins, and turned down until the planar faces of the shoulders 28 engage the fabric 26. Further rotation of the threaded nuts causes compression of the fabric 26 and a resilient locking effect. The tightening of the threaded nuts 20 by the fingers of the user is facilitated through the partial spherical configuration for the head portion 30 of the nut.

Figure 3:
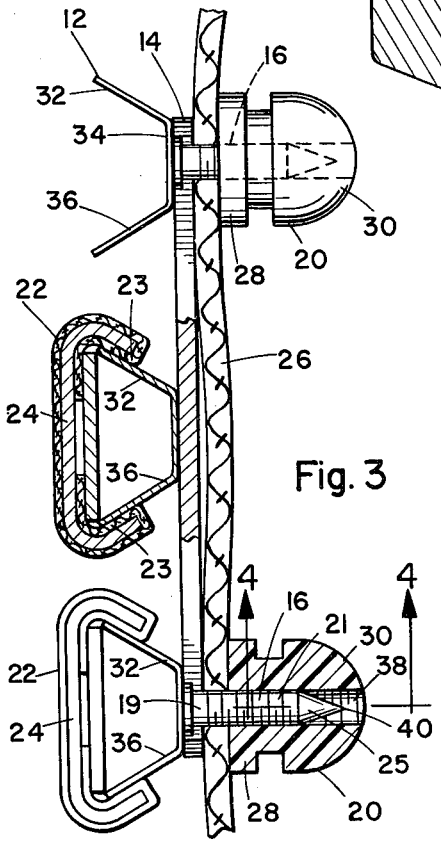
FIG. 3 is an enlarged end view of the holder, with portions cut away.

The channels 12 are of an open based truncated triangle configuration comprising a first leg 32, truncated portion 34 and second leg portion 36. Channel 12 is of a stainless steel material which is sufficiently resilient to engage and hold the fabric inner portion 23 of a standard ribbon 22 and bias the fabric against the ribbon mounting plate 24 to provide a frictional locking engagement. The frictional engagement ensures that each of the plurality of ribbons received over the plural ribbon support channels 12 will be securely held in position until it is positively removed by sufficient force along the axos of the channel 12. Also illustrated in FIG. 3 is the detailed configuration for the pin 16 which is shown to comprise an elongated shank having an initial unthreaded segment 19, a threaded segment 21, and a sharp pointed tip 25. In the instant embodiment the overall length of the threaded pin 16 from the rear of the channel 12 to the tip 40 is 0.375 inches; as will be more fully described hereinafter the exterior diameter of the threaded portion of the shank is 0.0410 inches. The length of the unthreaded and tapered tip portion 40 is 0.094 inches. Thus the tapered portion 40, has a relatively large ramp in relation to the diameter of the threaded pin 16, and is sharpened to a sharp point. This configuration ensures easy initial penetration of the fabric of the military uniform and a gradual transition to the untapered and threaded portion. The unthreaded shank portion 19 is approximately ⅛ of the overall length of the threaded pin 16, and, as appears in FIG. 3, does not protrude beyond the normal uniform fabric 26 after the device has been installed. Therefore this portion of the device does not interfer with the functioning but substantially increases the strength due to the elimination of 'notches' adjacent the attachment to the channels 12. The base material for the threaded pin 16 is a high chromium corrosion resisting steel of the stainless steel variety, but having quantities of sulphur added to increase its machinability. An acceptable material for this pin is carpenter stainless No. 5 (type 416) which has the following approximate analysis:

| | |
|---|---|
| carbon — .15% maximum | phosphorus — .06% maximum |
| sulphur — .15% minimum | mangenese — 1.25% maximum |
| silicon — 1.00% maximum | chromium — 12–14% maximum |

Threaded pins made from the stainless alloy described above are not abraded by contact with any materials normally found in association with uniforms and do not wear from contact with the plastic nut 20. In addition, they do not deteriorate if exposed to moisture and other commonly encountered materials used in association with personal hygiene or garment cleaning.

Figure 4:
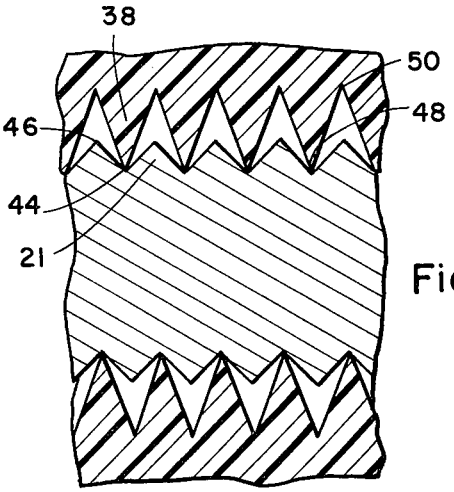
FIG. 4 is an enlarged sectional view taken on line 4–4 of FIG. 3.

Referring to FIG. 4, detailed inter-relationship between the threads on the threaded shank portion 21 of the pin 16 with respect to the threads 38 of the nut 20 is illustrated. The threads 38 are of a standard configuration for the 00/90 series. They have a nominal minor diameter of 0.035 and a major diameter of 0.052. Thus the nominal thread depth being 1/2 the difference in diameters in 0.0085.

The thread dimensions for the threaded pin 20, contrast with those for the nut in that a maximum thread depth of 0.003 inches is employed between the inner groove 44 of the threads and the outer thread tip 46. Accordingly, the tip 46 of the threads 21 on the threaded pin 16, extends only approximately 1/3 of the way to the maximum depth 50 of the threads on the nut 20. This leaves a substantial portion of the plastic material on the plastic nut 20 untrapped by the stainless steel material of the threaded pin. Because of the inherent flexibility of the plastic material, and this untrapped length, there is substantial freedom to resiliently bend about the depth of the thread without damaging either the material of the plastic nut 20 or the threads of the threaded pin 16. Therefore it is possible to cross thread the nut 20 onto the threaded pin 16 without damage to either nut or pin. At the same time the compressive strength of the plastic material is sufficient to prevent the threads from skipping under the loads necessary to resiliently lock the nut 20 against the uniform material 26. The relative ratio of thread depths of approximately 1 to 3 is particularly advantageous and therefore is illustrated in the preferred embodiment. However, it has been found that relative depth ratios up to a ratio of one to two work adequately well in so far as providing sufficient bending to avoid breakage of the plastic threads. At the same time, the thread depth employed on the threaded pin can vary over a range of 0.002 to 0.005 and still retain satisfactory nut thread engagement and material insertion characteristics.

Having described my invention, I now claim:

1. A holder for supporting a display object on fabric comprising:

a display object, a threaded pin having helical threads, said pin comprising an elongated threaded member secured to said display object and having a pointed terminal portion, threaded nut means having helical threads for engagement with said threaded member and for engaging and compressing said fabric, said threaded nut means is comprised of flexible plastic material, the threads on said threaded pin having a depth less than one-half of the thread depth for said threaded nut means, and said threaded pin has a thread depth in the range of two thousandths to five thousandths of an inch.

2. The holder of claim 1 wherein:

said threaded pin is comprised of machinable stainless steel.

3. The holder of claim 1 wherein:

the major diameter of said pin is substantially .041 thousandths inch.

4. The holder of claim 3 wherein:

said thread pin is not threaded immediately adjacent said ribbon support channel.

5. The holder of claim 1 wherein:

said threaded nut means is comprised of acetal resin.

6. The holder of claim 5 wherein:

said threaded pin is comprised of machinable stainless steel.

7. The holder of claim 1 wherein:

said thread nut means and said threaded pin have threads with a pitch of approximately 90 threads per inch.

8. The holder of claim 1 wherein:

said threaded nut means comprises a nut element having a substantially planar shoulder for engaging said fabric and a partial spherical head.

9. The holder of claim 1 wherein:

said display object comprises a ribbon support channel for receiving and retaining military ribbons, a plurality of said ribbon support channels are secured in spaced relation by a plurality of substantially vertical channel support bars, said channel support bars being secured to each of said plurality of ribbon support channels, and a plurality of said threaded pins are received on said holder.

10. The military ribbon holder of claim 9 wherein:

said ribbon support channel comprises three planar sides forming, in cross section, an open base truncated triangle.

* * * * *